US012584641B2

(12) United States Patent
Tong et al.

(10) Patent No.: US 12,584,641 B2
(45) Date of Patent: Mar. 24, 2026

(54) TEMPERATURE CONTROL SYSTEM COUPLED WITH HEAT PUMP WATER HEATER

(71) Applicant: ZHONGSHAN AMITIME ELECTRIC CO., LTD., Zhongshan (CN)

(72) Inventors: Fengxi Tong, Foshan (CN); Shaohuan Zeng, Meizhou (CN); Shuangming Zheng, Foshan (CN); Tao Li, Maoming (CN)

(73) Assignee: ZHONGSHAN AMITIME ELECTRIC CO., LTD., Zhongshan (CN)

( * ) Notice: Subject to any disclaimer, the term of this patent is extended or adjusted under 35 U.S.C. 154(b) by 107 days.

(21) Appl. No.: 18/572,810

(22) PCT Filed: May 27, 2022

(86) PCT No.: PCT/CN2022/095415

§ 371 (c)(1),
(2) Date: Jan. 22, 2024

(87) PCT Pub. No.: WO2022/267814

PCT Pub. Date: Dec. 29, 2022

(65) Prior Publication Data

US 2024/0288187 A1 Aug. 29, 2024

(30) Foreign Application Priority Data

Jun. 21, 2021 (CN) ..... 202110688151.0
Feb. 18, 2022 (CN) ..... 202210151922.7

(51) Int. Cl.
*F24F 1/0003* (2019.01)
*F24F 5/00* (2006.01)
*F24H 4/04* (2006.01)

(52) U.S. Cl.
CPC ..... *F24F 5/0096* (2013.01); *F24F 1/0003* (2013.01); *F24H 4/04* (2013.01)

(58) Field of Classification Search
CPC ..... F24F 5/0096; F24F 1/0003; F24H 4/04; F24D 2200/123; F24D 3/08; F24D 3/18;
(Continued)

(56) References Cited

U.S. PATENT DOCUMENTS

2016/0003486 A1* 1/2016 Minamisako ..... G08B 21/182 122/15.1
2025/0129965 A1* 4/2025 Lecoq ..... F24H 15/219

FOREIGN PATENT DOCUMENTS

CN 102155820 A 8/2011
CN 202092363 U 12/2011
(Continued)

OTHER PUBLICATIONS

International search report of PCT Patent Application No. PCT/CN2022/095415 issued on Aug. 29, 2022.

*Primary Examiner* — Marc E Norman

(57) ABSTRACT

Disclosed is a temperature control system coupled with a heat pump water heater. The temperature control system comprises a heat exchange unit, a heat exchanger, a supply water pipeline, a return water pipeline, a room temperature control apparatus, a heat pump water heater, a buffer water tank and a water pump. The heat pump water heater comprises a temperature-rise water tank, a heat pump evaporator and a compressor. The heat pump evaporator is coupled to the return or supply water pipeline. In a coupled form, an outdoor unit of the heat pump water heater is replaced by the heat exchange unit via a circulating water body, so that a room temperature adjustment system shares the heat exchange unit with a hot water supply system. Moreover, multiple households can share one heat exchange unit,
(Continued)

which is of great significance for apartments and rental houses.

12 Claims, 4 Drawing Sheets

(58) Field of Classification Search
CPC ... F24D 11/0214; F24D 17/02; F24D 19/1072
See application file for complete search history.

(56) References Cited

FOREIGN PATENT DOCUMENTS

| | | | |
|---|---|---|---|
| CN | 204460699 | U | 7/2015 |
| CN | 104833087 | A | 8/2015 |
| CN | 206755581 | U | 12/2017 |
| CN | 208720535 | U | 4/2019 |

* cited by examiner

TEMPERATURE CONTROL SYSTEM COUPLED WITH HEAT PUMP WATER HEATER

TECHNICAL FIELD

The invention relates to a temperature control system coupled to a heat pump water heater. More specifically, the invention relates to a temperature control system utilizing a circulating water coupled to a heat pump water heater.

BACKGROUND TECHNOLOGY

In order to live comfortably, people often need to install air conditioning, floor heating, water heaters and other equipment to adjust a room temperature and provide hot water. Usually heat pump water heaters are used as water heaters.

Heat pump water heater is also known as air source heat pump water heater, namely air energy water heater. Its working principle is very similar to an air conditioner, in which a small amount of electric energy is used to drive a compressor to operate, a liquid working medium in high pressure is evaporated to a gas in an evaporator through an expansion valve with a large amount of heat being absorbed from the air, and the gaseous medium is compressed again into a liquid medium with high temperature and high pressure by the compressor and then enters into a condenser to heat the water. Such a cycle is repeated continuously with the water being heated to 50° C.-65° C. In such a process, with every one part of electric energy being consumed to drive the compressor, about four parts of heat are absorbed and transferred from an ambient air into the water. Therefore, compared with an ordinary electric water heater, an air energy water heater can save nearly ¾ of the electric energy. Namely the hot water produced by an ordinary electric water heater with consuming 4 Kw·h electric energy can be produced by an air energy water heater with only consuming 1 Kw·h electric energy.

All the above-mentioned equipment needs an independent outdoor host to exchange heat with the environment. However, in some special domicile such as apartments and rental houses, due to a small overall space it is difficult to install so many outdoor hosts, and the installation and maintenance are also difficult, resulting in non-convenient lives for users.

Therefore, it is necessary to provide a temperature control system, which can not only provide a hot water needed for daily life, but also can adjust an indoor environmental temperature with occupying a small space and saving electric energy.

SUMMARY OF THE INVENTION

It is an object of the present invention to provide a temperature control system by utilizing circulating water coupled to a heat pump water heater to provide an indoor hot water and to adjust a room temperature in one-time solution.

In order to realize the object of the present invention, it is provided a temperature control system by utilizing circulating water coupled to a heat pump water heater, comprising:

- a heat exchanging host, which is equipped with a heat exchanger and a cooling system,
- a supply water pipeline, which is connected to the heat exchanger,
- a return water pipeline, in which at least one room temperature adjusting apparatus is installed in parallel between the return water pipeline and the supply water pipeline,

- a heat pump water heater, which further comprises a temperature-rise water tank, a heat pump evaporator and a compressor wherein the temperature-rise water tank is provided with a heat exchanging tube with its two ends connected to the heat pump evaporator and the compressor, wherein an expansion valve is provided between the heat exchanging tube and the heat pump evaporator, wherein the heat pump evaporator is connected with the compressor and coupled to the return water pipeline or supply water pipeline, and wherein the temperature-rise water tank is provided with a cold water inlet and a hot water outlet,
- a buffer water tank, which is connected with the end of the return water pipeline and the heat exchanger respectively wherein there is a circulating water body provided in the buffer water tank, the supply water pipeline and the return water pipeline, and
- a water pump, which is provided on the supply water pipeline or the return water pipeline.

In the above-mentioned technical solution, the temperature of the circulating water body can be adjusted by the heat exchanging host in which the water at a certain temperature is flowed out of the supply water pipeline to each room temperature adjusting apparatus to adjust the indoor temperature, then the temperature of the water is changed and the water at changed temperature is returned to the buffer water tank through the return water pipeline, and then the water is continuously flowed to the heat exchanging host for temperature regulating cycle. The heat pump evaporator of the heat pump water heater is coupled to the return water pipeline or the supply water pipeline in which the heat of the circulating water body is absorbed by the heat pump evaporator, the temperature of the heat medium in the heat pump evaporator is increased with the temperature of the circulating water body within it decreased, and then the water in the temperature-rise water tank is heated by the compressor and the heat exchanging tube for providing domestic hot water. A separate outdoor host was originally needed by the heat pump water heater, but with the coupled form this outdoor host of the heat pump water heater can be replaced by the heat exchanging host through the circulating water body, and therefore the heat exchanging host is shared by a room temperature conditioning system and a hot water supply system to save space, in which the heat exchanging host can further be shared by multiple households which will have very important significance for apartments and rental rooms. At the same time, the circulating water body itself has a high capacity for energy storage. Even if the heat exchanging host is not in a working state, the circulating water body can still have a large thermal energy storage, which means it will save more energy as a whole. In the summer when the power requirement of the heat exchanging host is relatively large, the heat pump evaporator of the heat pump water heater can reduce the water temperature of the circulating water body, and because the water at low temperature is needed in the summer itself the coupling can instead reduce the burden of the heat exchanging host. In the winter, although the heat pump water heater will increase the burden of the heat exchanging host, the heat producing capacity of the heat exchanging host itself is stronger than its refrigeration capacity and the power of the heat exchanging host has enough surplus in winter. Therefore, a good burden balance of the heat exchanging host can be achieved during the four seasons through the heat pump water heater, so that the power of the heat exchanging host is more balanced in the four seasons and the overall efficiency is more balanced.

Preferably, according to the technical solution of the present invention, the cooling system of the heat exchanging host can comprise a heat exchanging evaporator, a four-way valve, a heat exchanging compressor, and an electronic expansion valve, in which one end of the heat changing evaporator is connected to the four-way valve and the other end is connected to the electronic expansion valve, and the other end of the electronic expansion valve is connected to the heat exchanger. The two ends of the heat exchanging compressor are connected to the four-way valve, and the four-way valve is connected to the heat exchanger.

As a further improvement of the above technical solution, the heat exchanging tube can be fixed in the temperature-rise water tank in a spiral shape.

As a further improvement of the above technical solution, the buffer water tank can be placed near the bottom of the heat exchanging host to make the whole structure more compact.

According to the technical solution of the present invention, there are preferably a plurality of the room temperature adjusting apparatuses. For example, the room temperature adjusting apparatuses can comprises at least one fan coil and/or at least one floor heating. Thus, in hot days, the fan coil can be used to provide cold air for a plurality of rooms, while in cold days the floor heating can be used to provide heat for a plurality of rooms.

As a further improvement of the above technical solution, the heat pump evaporator can be coupled to the return water pipeline in series.

According to the technical solution of the present invention, the temperature control system can further comprise a branch line which is in parallel with the return water pipeline or the supply water pipeline. The heat pump evaporator is located in the branch line.

The advantage of setting up the branch line is that it can reduce the water resistance of the return water pipeline or supply water pipeline and thus balance the water pressure of the return water pipeline or supply water pipeline and the branch line, so as to keep the temperature control system in a high efficiency and convenient for installation.

In the technical solution with the branch line of the present invention, the diameter of the branch line is preferably less than the diameter of the return water pipeline or that of the supply water pipeline.

In the technical solution with the branch line of the present invention, in order to better control the pressure of the water circulation loop and that of the system, the temperature control system can further comprise a pressure regulating valve, which can be located in the return water pipeline or supply water pipeline, in which the branch line is connected with the return water pipeline or supply water pipeline at the ends of the pressure regulating valve.

The above pressure regulating valve can be a mechanical valve or an electric valve. If the pressure regulating valve is an electric valve, it is easier to be interacted with the heat pump water heater.

In the technical solution with the branch line of the present invention, the temperature control system can further comprise a three-way valve which is located in the return water pipeline or supply water pipeline and connected with one end of the branch line.

In the temperature control system of the present invention the heat pump evaporator is coupled to the return water pipeline or supply water pipeline. Through the coupled form, the outdoor host of the heat pump water heater can be replaced by the heat exchanging host through the circulating water body, and thus the heat exchanging host is shared by the room temperature conditioning system and the hot water supply system for saving space, in which the heat exchanging host can further be shared by multiple households. In a sense, the temperature control system of the present invention can be regarded as a heat pump air conditioning coupled to a heat pump water heater, and by setting up the branch line the water resistance of the return water pipeline or supply water pipeline can be reduced in order to balance the water pressure of the return water pipeline or supply water pipeline and that of the branch line to ensure the whole temperature control system in a high efficiency.

The present invention will be further explained in the following in combination with the drawings and specific embodiments. However, those skilled in the art can understand that the present invention is not limited to these specific embodiments, and under the inventive conception of the present invention, all the equivalent structure transformation inspired by its specification and its drawings, even directly or indirectly in other related technical fields, are comprised in the protection scope of the claims of the present invention.

DETAILED DESCRIPTION OF THE PRESENT INVENTION

Figure 1:
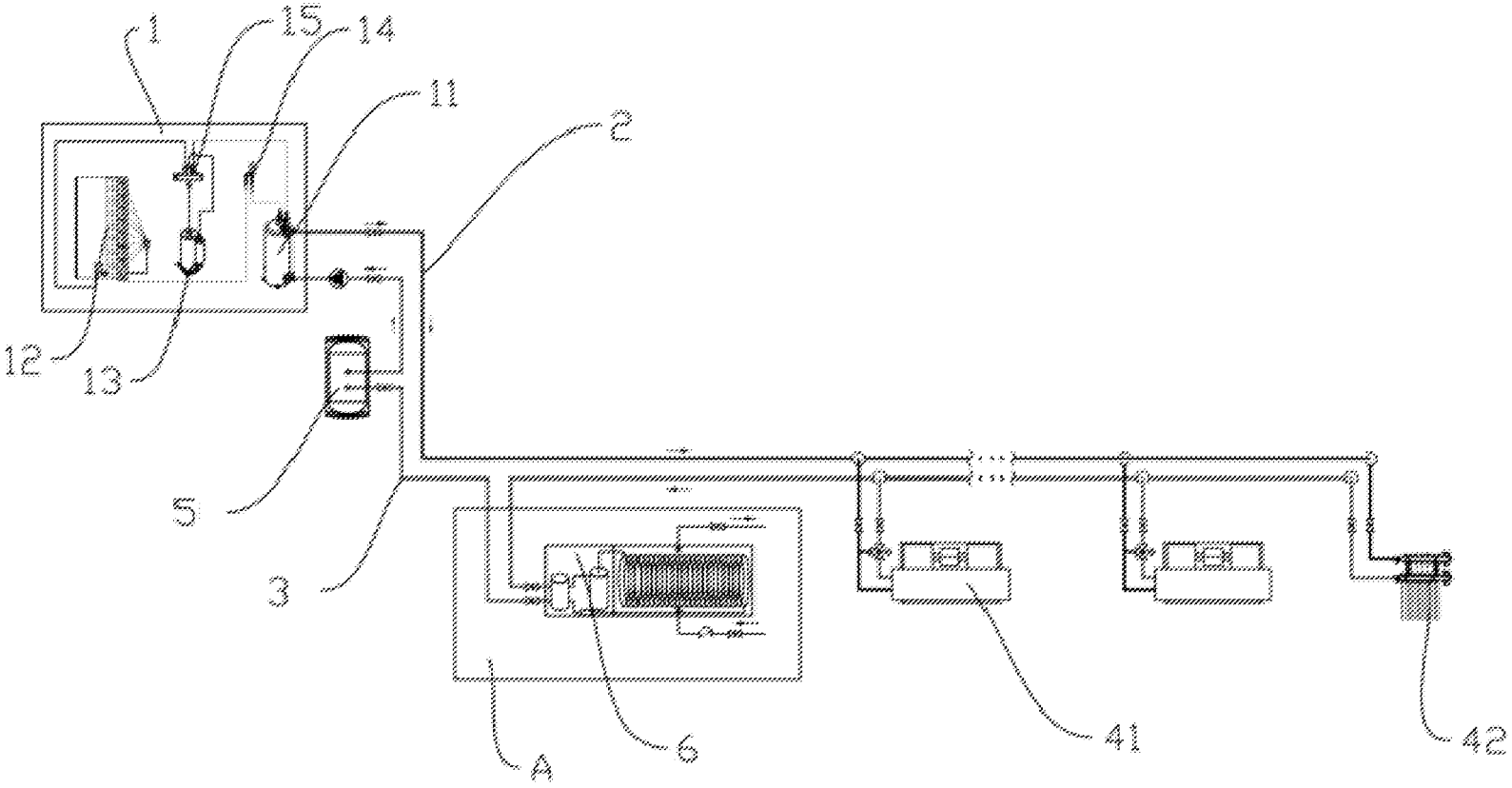
FIG. 1 is a schematic diagram of the first embodiment of the present invention.

Specific embodiments of the present invention will be described in detail below, and some preferable embodiments of the present invention are shown in the accompanying drawings. The function of the drawings is to supplement the description of the text part with the figures, so as to make the skilled one intuitively and vividly understand the overall technical features of the present invention, but it cannot be understood as a limitation on the protection scope of the present invention.

In the description of the present invention, it should be understood that with respect to the orientation description, such as the top, bottom, front, back, left, right, the indicated orientation or position relations are based on the orientation or position relations shown in the drawings, only in order to facilitate the description of the present invention and to simplify the description, rather than to indicate or imply that the device or element must have a specific orientation, construct and operate in a specific orientation, and therefore cannot be understood as a limitation of the invention.

In the description of the present invention, the term "at least one" means one or more, the term "a plurality of" means more than two, the terms "greater than", "less than" or "more than" should be understood as excluding the related number, and the terms "above", "below" and "within" should be understood as including the related number. If the terms "first" and "second" are used they are only for the purpose of distinguishing technical features and cannot be understood as indicating or implying relative importance or implicitly indicating the quantity of the indicated technical features or the sequence of the indicated technical features.

In the description of the present invention, unless otherwise clearly defined, the terms "setting", "installation", "connection" and their similar terms should be generally understood, and the skilled one in the art can reasonably determine the specific meaning of these terms in the present invention in combination with the specific contents of the technical solution.

Figure 2:
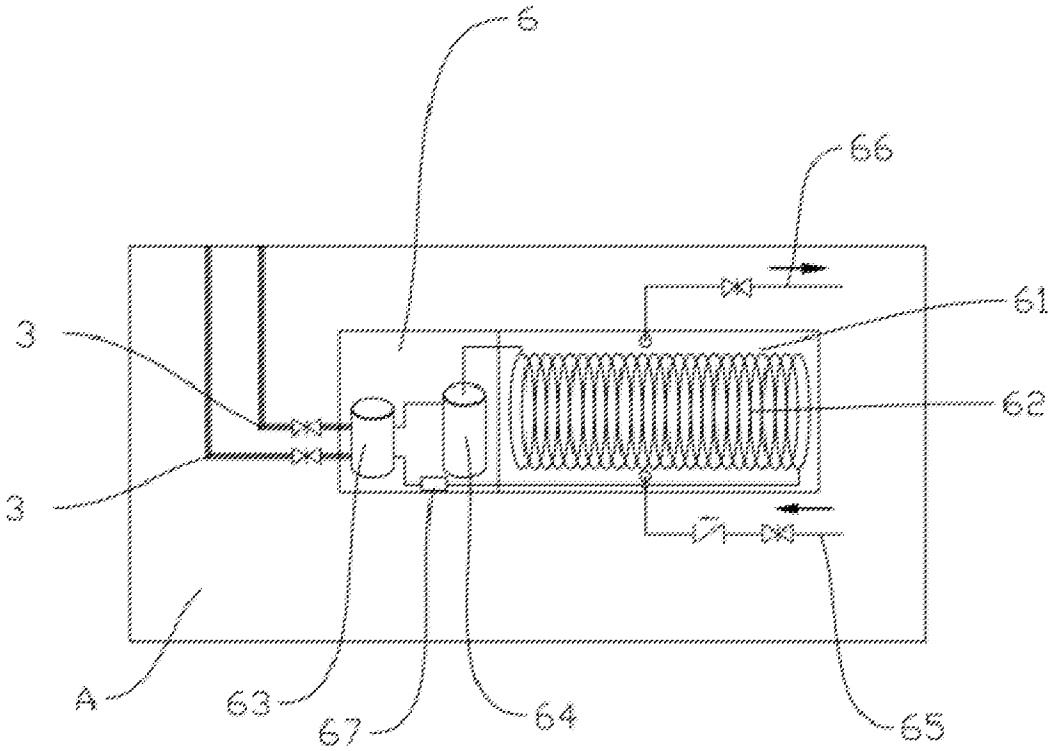
FIG. 2 is the local amplification view at A in FIG. 1.

Refer to FIGS. 1 to 2, which shows a specific embodiment of a temperature control system of the present invention with a circulating water coupled with a heat pump water heater, where the temperature control system comprises:

- a heat exchanging host 1, which has a heat exchanger 11 and a cooling system,
- a supply water pipeline 2, which is connected with the heat exchanger 11,
- a return water pipeline 3, in which at least one room temperature adjusting apparatus such as 41,42 is installed in parallel between the return water pipeline 3 and the supply water pipeline 2,
- a heat pump water heater 6, which further comprises a temperature-rise water tank 61, a heat pump evaporator 63 and a compressor 64 wherein the temperature-rise water tank 61 is provided with a heat exchanging tube 62 with its two ends connected to the heat pump evaporator 63 and the compressor 64 respectively, wherein an expansion valve 67 is provided between the heat exchanging tube 62 and the heat pump evaporator 63, wherein the heat pump evaporator 63 is connected with the compressor 64 and coupled to the return water pipeline 3 or supply water pipeline 2, and wherein the temperature-rise water tank is provided with a cold water inlet 65 and a hot water outlet 66,
- a buffer water tank 5, which is connected with the heat exchanger 11 and the end of the return water pipeline 3 with a circulating water body provided in the buffer water tank 5, the supply water pipeline 2 and the return water pipeline 3, and
- a water pump, which is provided in the supply water pipeline 2 or in the return water pipeline 3.

The temperature of the circulating water body can be adjusted by the heat exchanging host 1 in which the water at a certain temperature is flowed out of the supply water pipeline 2 to each room temperature adjusting apparatus to adjust the indoor temperature, then the temperature of the water is changed and the water at changed temperature is returned to the buffer water tank 5 through the return water pipeline 3 and then continuously flowed to the heat exchanging host 1 for temperature regulating cycle. The heat pump evaporator 63 of the heat pump water heater 6 is coupled to the return water pipeline 3 or the supply water pipeline 2 in which the heat of the circulating water body is absorbed by the heat pump evaporator 63, the temperature of the heat medium in the heat pump evaporator 63 is increased with the temperature of the circulating water body within it decreased, and then the water in the temperature-rise water tank 61 is heated by the compressor 64 and the heat exchanging tube 62 for providing households with hot water. A separate outdoor host was originally needed by the heat pump water heater 6, but with the coupled form this kind of outdoor host of the heat pump water heater 6 can be replaced by the heat exchanging host 1 through the circulating water body, and therefore the heat exchanging host 1 is shared by a room temperature conditioning system and a hot water supply system in which the space can be saved and the heat exchanging host 1 can further be shared by multiple households.

Because the circulating water body itself has a high capacity for energy storage, even when the heat exchanging host 1 is not in a working state, the circulating water body can still have a large thermal energy storage, which can be used by the heat pump water heater 6 and means it will save more energy as a whole.

In the summer when the power requirement of the heat exchanging host 1 is relatively large, the heat pump evaporator 63 of the heat pump water heater 6 can reduce the water temperature of the circulating water body, and because the water at low temperature is needed in the summer itself the coupling can instead reduce the burden of the heat exchanging host 1. And in the winter, although the heat pump water heater 6 will increase the burden of the heat exchanging host 1, the heat producing capacity of the heat exchanging host 1 itself is stronger than its refrigeration capacity and the power of the heat exchanging host 1 has enough surplus in winter, and the power of the heat exchanging host 1 is more balanced in the four seasons.

In the above embodiment, it is preferred that the heat pump evaporator 63 can be coupled in series to the return water pipeline 3, but the heat pump evaporator 63 can also be coupled in series to the supply water pipeline 2, or the heat pump evaporator 63 can also be coupled to the return water pipeline 3 and the supply water pipeline 2 in parallel. The specific choice is determined according to the use requirements and installation requirements.

Furthermore, the cooling system of the heat exchanging host 1 can comprises a heat exchanging evaporator 12, a four-way valve 15, a heat exchanging compressor 13 and an electronic expansion valve 14 in which one end of the heat exchanging evaporator 12 is connected to the four-way valve 15 and the other end of the heat exchanging evaporator 12 is connected to the electronic expansion valve 14, and the other end of the electronic expansion valve 14 is connected to the heat exchanger 11. The two ends of the compressor 64 are connected to the four-way valve 15, and the four-way valve 15 is connected to the heat exchanger 11.

Preferably, the heat exchanging tube 62 can be fixed in the temperature-rise water tank 61 in a spiral shape. Or the heat exchanging tube 62 can be coiled around the outer surface of the temperature-rise water tank 61 in a spiral manner. Specific form can be selected in real time according to the production requirements.

As a more specific solution, the buffer water tank 5 can be provided near the bottom of the heat exchanging host 1.

As another more specific solution, the room temperature adjusting apparatus can be a fan coil 41 and/or a floor heating 42.

Figure 3:
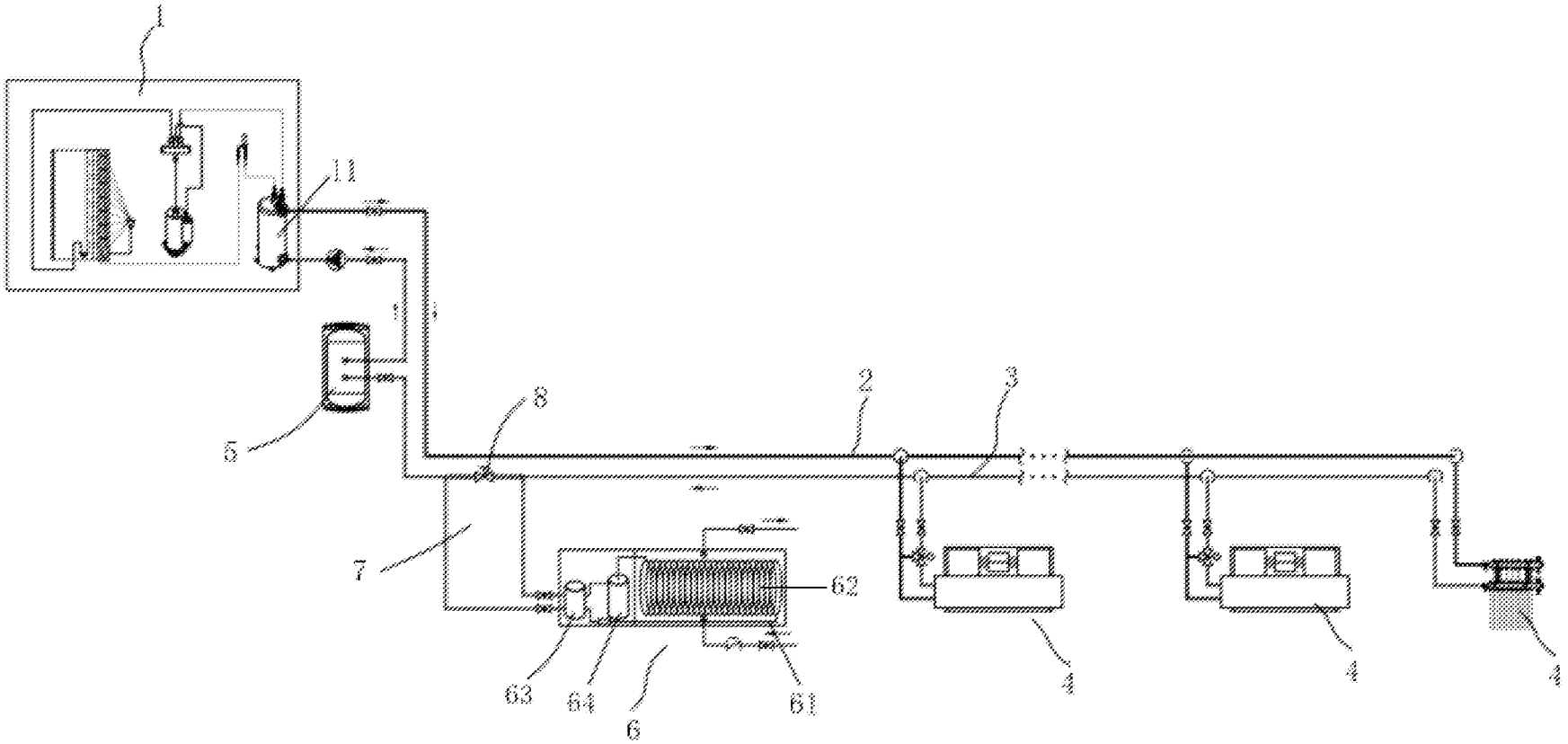
FIG. 3 is a schematic diagram of the second embodiment of the present invention.

FIG. 3 shows another specific embodiment of a temperature control system with a circulating water coupled with a heat pump water heater, in which the temperature control system comprises a heat exchanging host 1, a supply water pipeline 2, a return water pipeline 3, temperature adjusting apparatuses 4, a buffer water tank 5 and a heat pump water heater 6. The heat exchanging host 1 comprises a heat exchanger 11 and a cooling system. The structure of the heat pump water heater 6 are shown in FIG. 2, which also comprises the temperature-rise water tank 61, the heat pump evaporator 63 and the compressor 64. The temperature-rise water tank 61 is provided with a heat exchanging tube 62 in which the two ends of the heat exchanging tube 62 are connected with the heat pump evaporator 63 and the compressor 64 respectively. The heat pump evaporator 63 is connected to the compressor 64. The heat pump evaporator 63 is coupled to the return water pipeline 3 or the supply water pipeline 2, The temperature water tank is equipped with a cold water inlet 65 and a hot water outlet 66. The heat pump evaporator 63 is coupled to the return water pipeline 3 or the supply water pipeline 2. At least one room temperature adjusting apparatus 4 is installed in parallel between the return water pipeline 3 and the supply water pipeline 2.

Dual-channel heat transfer mode is used in the heat exchanger 11 and in the heat pump evaporator 63. The temperature adjusting apparatus 4 is a room temperature adjusting apparatus which can be a fan coil and/or a floor heating.

The temperature control system shown in FIG. 3 also comprises a shunt branch (branch line) 7.

The branch line 7 is connected in parallel with the return water pipeline 3, and the heat pump evaporator 63 is provided in this branch line. The diameter of the branch line 7 matches the diameter of the return water pipeline 3 to ensure the unimpeded backwater, and the rate of flow in the branch line and the energy of the heat pump evaporator 63 match. Such a technical solution solves the problem of affecting the circulation resulting from the existing technology in which the heat pump evaporator 63 is directly connected in series in the return water pipeline 3. The local part of the return water pipeline 3 and the shunt branch 7 can be installed as a whole unit, which can be installed quickly and conveniently.

In other words, the branch line 7 comprises a shunt inlet pipe and a shunt outlet pipe in which the shunt inlet pipe is connected with the inlet end of the heat pump evaporator 63, and the shunt outlet pipe is connected with the outlet end of the heat pump evaporator 63.

Alternatively, the diameter of the branch line is less than the diameter of the return water pipeline or that of the supply water pipeline.

The temperature control system shown in FIG. 3 can also comprise a pressure regulating valve 8 located in the return water pipeline 3 or in the supply water pipeline 2, and the branch line is in communication with the return water pipeline 3 or the supply water pipeline 2 at both ends of the pressure regulating valve 8. The branch line 7 and the pressure regulating valve 8 can be made into one unit component which is easy to be installed.

The pressure regulating valve 8 can be a mechanical valve. It and the branch line 7 can constitute parallel components, which can be produced in batch based on the corresponding requirements of different batch and different functions.

The pressure regulating valve 8 can also be an electric valve and it can be interacted with the heat pump water heater 6. With such a structure, the flow rate and pressure of the branch line 7 increases automatically when the heat pump water heater 6 is in a working state, and the flow rate and pressure of the branch line 7 decreases automatically when the heat pump water heater 6 stops working. That is, as the heat pump water heater 6 is in a working state or in a static state, the branch line 7 converts its flow rate and pressure.

Figure 4:
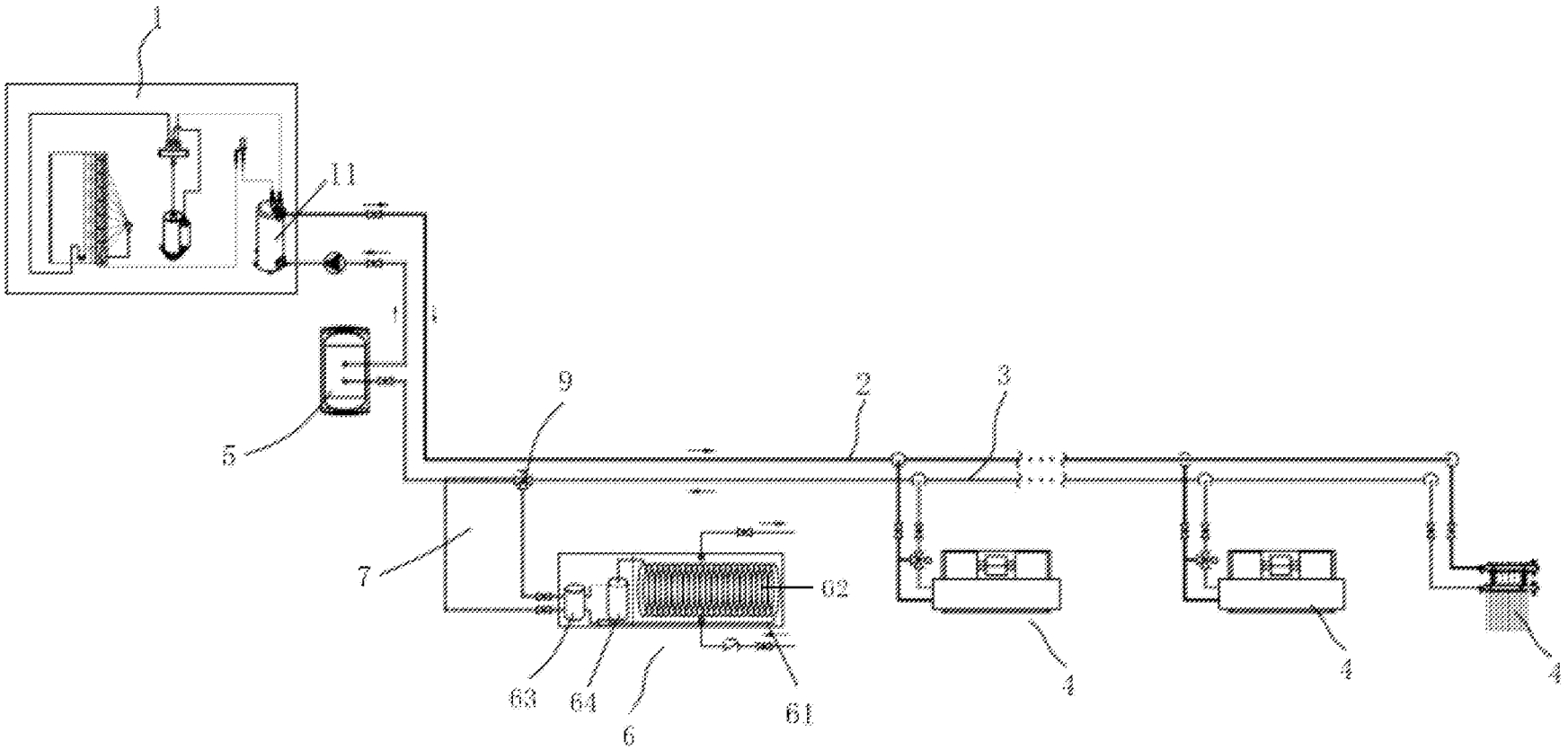
FIG. 4 is a schematic diagram of the third embodiment of the present invention.

As shown in FIG. 4 is a further another embodiment of the temperature control system with a circulating water coupled with a heat pump water heater, which is basically the same as the temperature control system shown in FIG. 3, but this embodiment also comprises a three-way valve 9. The three-way valve 9 is located in the return water pipeline 3 or in the supply water pipeline 2 and connected with one end of the branch line 7, and the heat pump evaporator 63 is provided in the branch line 7.

Although some embodiments of the present invention are described in the above description, those skilled in the art can understand that it is probable to make various amendments, modifications, replacements and transforms based on these embodiments without departing from the principle and purpose of the present invention.

The invention claimed is:

1. A temperature control system with a circulating water coupled with a heat pump water heater, comprising:

a heat exchanging host (1), in which said heat exchanging host (1) is equipped with a heat exchanger (11) and a cooling system, a supply water pipeline (2), in which said supply water pipeline (2) is in communication with said heat exchanger (11), a return water pipeline (3), in which at least one room temperature adjusting apparatus is installed in parallel between said return water pipeline (3) and said supply water pipeline (2), a heat pump water heater (6), in which said heat pump water heater (6) further comprises a temperature-rise water tank (61), a heat pump evaporator (63), and a compressor (64) wherein said temperature-rise water tank (61) is provided with a heat exchanging tube (62) with the two ends of said heat exchanging tube (62) being connected to said heat pump evaporator (63) and said compressor (64) respectively, wherein an expansion valve (67) is provided between said heat exchanging tube (62) and said heat pump evaporator (63), wherein said heat pump evaporator (63) is in communication with said compressor (64) and coupled to said return water pipeline (3) or said supply water pipeline (2), and wherein said temperature-rise water tank (61) is provided with a cold water inlet (65) and a hot water outlet (66), a buffer water tank (5), in which said buffer water tank (5) is connected to said heat exchanger (11) and to the end of said return water pipeline (3), and there is a circulating water body provided in said buffer water tank (5), said supply water pipeline (2) and said return water pipeline (3), and a water pump, in which said water pump is provided in the supply water pipeline (2) or in the return water pipeline (3).

2. The temperature control system according to claim 1, wherein said cooling system of said heat exchanging host (1) further comprises a heat exchanging evaporator (12), a four-way valve (15), a heat exchanging compressor (13) and an electronic expansion valve (14) in which one end of said heat exchanging evaporator (12) is connected to said four-way valve (15) with the other end of said heat exchanging evaporator (12) being connected to one end of said electronic expansion valve (14), the other end of said electronic expansion valve (14) is connected to said heat exchanger (11), the two ends of said heat exchanging compressor (13) are connected to said four-way valve (15), and said four-way valve (15) is further connected to said heat exchanger (11).

3. The temperature control system according to claim 1, wherein said heat exchanging tube (62) is fixed in/on said temperature-rise water tank (61).

4. The temperature control system according to claim 1, wherein said buffer water tank (5) is located at the bottom of said heat exchanging host (1).

5. The temperature control system according to claim 1, wherein said room temperature adjusting apparatus is a fan coil (41) and/or a floor heating (42).

6. The temperature control system according to claim 1, wherein said heat pump evaporator (6) is coupled in series to said return water pipeline (3).

7. The temperature control system according to claim 1, wherein said temperature control system further comprises a shunt branch (7) connected in parallel with said return water pipeline (3) or said supply water pipeline (2), and said heat pump evaporator (63) is located in said shunt branch (7).

8. The temperature control system of claim 7, wherein the diameter of said shunt branch (7) is less than the diameter of said return water pipeline (3) or that of said supply water pipeline (2).

9. The temperature control system according to claim 8, wherein said temperature control system further comprises a pressure control valve (8) located in said return water pipeline (3) or in said supply water pipeline (2), and said shunt branch (7) is in communication with said return water pipeline or said supply water pipeline at both ends of said pressure control valve (8).

10. The temperature control system according to claim 9, wherein said pressure regulating valve (8) is a mechanical valve.

11. The temperature control system of claim 9, wherein said pressure regulating valve (8) is an electric valve and interacted with said heat pump water heater (6).

12. The temperature control system according to claim 8, wherein said temperature control system further comprises a three-way valve (9) which is located in said return water pipeline (3) or said supply water pipeline (2) and which is connected with one end of said branch line (7).

* * * * *